US009640356B2

(12) United States Patent
Jiang et al.

(10) Patent No.: US 9,640,356 B2
(45) Date of Patent: May 2, 2017

(54) CLAPPING TYPE ELECTROMAGNETIC TRIPPING SYSTEM

(71) Applicant: ZHEJIANG CHINT ELECTRICS CO., LTD., Zhejiang (CN)

(72) Inventors: Huahua Jiang, Zhejiang (CN); Zengjin Diao, Zhejiang (CN); Yingchuan Zheng, Zhejiang (CN); Yanan Liu, Zhejiang (CN)

(73) Assignee: ZHEJIANG CHINT ELECTRICS CO., LTD. (CN)

( * ) Notice: Subject to any disclaimer, the term of this patent is extended or adjusted under 35 U.S.C. 154(b) by 0 days.

(21) Appl. No.: 15/112,342

(22) PCT Filed: Jan. 16, 2015

(86) PCT No.: PCT/CN2015/070829
§ 371 (c)(1),
(2) Date: Jul. 18, 2016

(87) PCT Pub. No.: WO2015/106709
PCT Pub. Date: Jul. 23, 2015

(65) Prior Publication Data

US 2016/0336135 A1 Nov. 17, 2016

(30) Foreign Application Priority Data

Jan. 17, 2014 (CN) ..... 2014 2 0027740 U

(51) Int. Cl.
*H01H 71/40* (2006.01)
*H01H 71/16* (2006.01)

(52) U.S. Cl.
CPC ..... *H01H 71/40* (2013.01); *H01H 71/164* (2013.01); *H01H 71/402* (2013.01); *H01H 2071/407* (2013.01)

(58) Field of Classification Search
CPC . H01H 71/40; H01H 71/402; H01H 2071/407
See application file for complete search history.

(56) References Cited

U.S. PATENT DOCUMENTS 5,872,495 A 2/1999 DiMarco et al.

FOREIGN PATENT DOCUMENTS

| | | |
|---|---|---|
| CN | 201204168 | 3/2009 |
| CN | 203746773 | 7/2014 |
| EP | 0 143 022 A1 | 5/1985 |

OTHER PUBLICATIONS

International Search Report dated Apr. 17, 2015 issued in corresponding International patent application No. PCT/CN2015/070829.

*Primary Examiner* — Ramon M Barrera
(74) *Attorney, Agent, or Firm* — Ostrolenk Faber LLP

(57) ABSTRACT

A clapping type electromagnetic tripping system comprises an iron core with a U-shaped structure, an armature, a heating element, a bimetallic element and a connecting plate; a bracket extends into a U-shaped groove of the iron core and is fixedly connected with the iron core, and a wire connecting the heating element and the connecting plate surrounds the iron core and the bracket; the bracket twined round by the wire is fixedly connected with the middle part of the heating element, the bottom end of the heating element and the bottom end of the bimetallic element are fixedly connected with a supporting member together, and the armature is hung on the bracket surrounded by the wire; and the armature and the iron core twined round by the wire are arranged oppositely to form a magnetic loop, and one end of the armature is attracted by the iron core so as to swing when short-circuit current is generated. The clapping type electromagnetic tripping system disclosed by the present invention-creation is simple and reasonable in structure and can enable the armature to be attracted reliably.

10 Claims, 4 Drawing Sheets

CLAPPING TYPE ELECTROMAGNETIC TRIPPING SYSTEM

CROSS REFERENCE TO RELATED APPLICATIONS

The present application is a 35 U.S.C. §371 National Phase conversion of PCT/CN2015/070829, filed Jan. 16, 2015, which claims benefit of Chinese application no. 201420027740.X, filed Jan. 17, 2014, the disclosures of which are incorporated herein by reference in their entirety. The PCT International Application was published in the Chinese language.

TECHNICAL FIELD

The present invention-creation belongs to the technical field of molded case circuit breakers, and more particularly relates to a clapping type electromagnetic tripping system of a molded case circuit breaker.

BACKGROUND ART

At present, a clapping type electromagnetic tripping system of a molded case circuit breaker in which an electromagnetic field is generated on an iron core using a short-circuited current flowing through a heating element and an armature is attracted to push a tripping rod to make a product disconnected ensures the safety of a power supply system; and this clapping type electromagnetic tripping system mainly comprises an iron core, an armature, a heating element, a thermal bimetallic element, a bracket, a supporting member, a flexible wire and a connecting plate. The heating element penetrates through a magnetic loop composed of the armature and the iron core, and a magnetic field will be generated on the iron core surrounding the heating element when the short-circuited current flows through the heating element; and if the generated magnetic field force is not sufficient to attract the armature, short-circuit protection fails, and in particular, in a clapping type electromagnetic tripping system of a specification of 63 A or less.

SUMMARY OF THE PRESENT INVENTION-CREATION

The present invention-creation aims to overcoming the defects of the prior art and provide a clapping type electromagnetic system which is simple in structure and high in reliability.

To achieve the object, the present invention-creation adopts the following technical solutions:

a clapping type electromagnetic tripping system comprises an iron core 107 with a U-shaped structure, an armature 101, a heating element 103, a bimetallic element 102 and a connecting plate 106, wherein a bracket 104 extends into a U-shaped groove of the iron core 107 and is fixedly connected with the iron core 107, and a wire 105 connecting the heating element 103 and the connecting plate 106 surrounds the iron core 107 and the bracket 104; the bracket 104 twined round(surrounded) by the wire 105 is fixedly connected with the middle part of the heating element 103, the bottom end of the heating element 103 and the bottom end of the bimetallic element 102 are fixedly connected with a supporting member 108 together, and the armature 101 is hung on the bracket 104 twined round (surrounded) by the wire 105; and the armature 101 and the iron core 107 twined round(surrounded) by the wire 105 are arranged oppositely to form a magnetic loop, and one end of the armature 101 is attracted by the iron core 107 so as to swing when short-circuit current is generated.

Further, the armature 101 comprises a sheet attracting portion 1011, a first hanging pillar 1013 and a second hanging pillar 1014 which are connected with the attracting portion 1011, and bending portions 1012 which are arranged at positions where the attracting portion 1011 is connected with the first hanging pillar 1013 and the second hanging pillar 1014, and extend towards the iron core 107; and a pair of projections 1015 which are in mounting fit to the bracket 104 are disposed on the first hanging pillar 1013 and the second hanging pillar 1014, and a propping portion 1016 which is used for triggering a tripping action and is bent in a direction away from the iron core 107 is disposed at the end portion of the first hanging pillar 1013.

Further, the iron core 107 is of a U-shaped structure composed of two sides 1071 and a bottom surface 1072, the two sides 1071 are uniform in shape and symmetrically arranged, and a bevel edge 1073 which can increase a swing range of the armature 101 along a movement direction of the armature 101 which is being attracted is disposed on each of the two sides.

Further, the bracket 104 comprises a sheet assisting portion 1041 which extends into the U-shaped groove of the iron core 107 and is fixedly connected with a bottom surface 1072 of the iron core 107, a pair of armature supporting arms 1042 which extend towards the armature 101 are disposed at the upper end of the assisting portion 1041 which is fixedly connected with the bottom surface 1072 of the iron core 107, and each of the pair of armature supporting arms 1042 is provided with a groove which is mounting fit to the iron core 107.

Further, the middle part of the bottom end of the attracting portion 1011 of the armature 101 is recessed, and a pair of bottom legs 1017 are disposed at two sides of the attracting portion 1011.

Further, the iron core 107 is disposed opposite to the attracting portion 1011 of the armature 101, and a width W2 of the core iron 107 is equal to a width W1 of the attracting portion 1011 of the armature 1011.

Further, a height H2 of the iron core 107 is equal to a height H1 of the attracting portion 1011 of the armature 101

Further, the supporting member 108 comprises a supporting member connecting sheet 1082 which is disposed under a recess in the middle part of the bottom end of the armature 101, and a connecting member fixing portion 1081 which is fixedly connected with the bottom end of a bimetallic sheet, and the conjunction between the supporting member fixing portion 1081 and the supporting member connecting sheet 1082 is of a vertical structure.

Further, a second wire 109 which does not twine round or surround the bracket 104 and the heating element 103 and is connected to the wire 105 in parallel is also connected between the heating element 103 and the connecting plate 106

Further, the wire 105 which twines round (surrounds) the iron core 107 and the bracket 104 is an enameled wire or a flexible connecting wire.

The clapping type electromagnetic tripping system disclosed by the present invention-creation is simple and reasonable in structure and can enable the armature to be attracted reliably. The clapping type electromagnetic tripping system is suitable for use in a low-current molded case circuit breaker with a clapping type electromagnetic structure, and in particular in a clapping type electromagnetic tripping system of a specification of 63 A or less.

DETAILED DESCRIPTIONS OF THE PREFERRED EMBODIMENTS

Specific embodiments of the clapping type electromagnetic system of the present invention-creation are further explained below in combination with embodiments described in FIGS. 1 to 6. The clapping type electromagnetic system of the present invention-creation is limited to the following specific description to embodiments.

Figure 1:
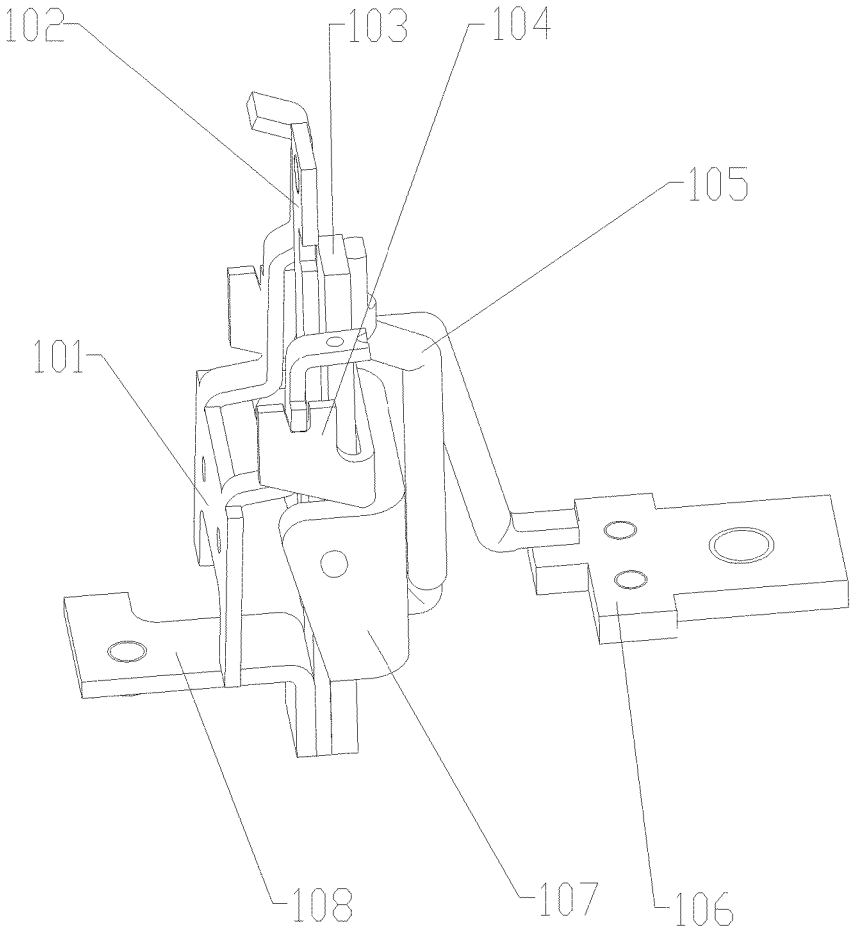
FIG. 1 is a structural view of the clapping type electromagnetic system of the present invention-creation.
Figure 2:
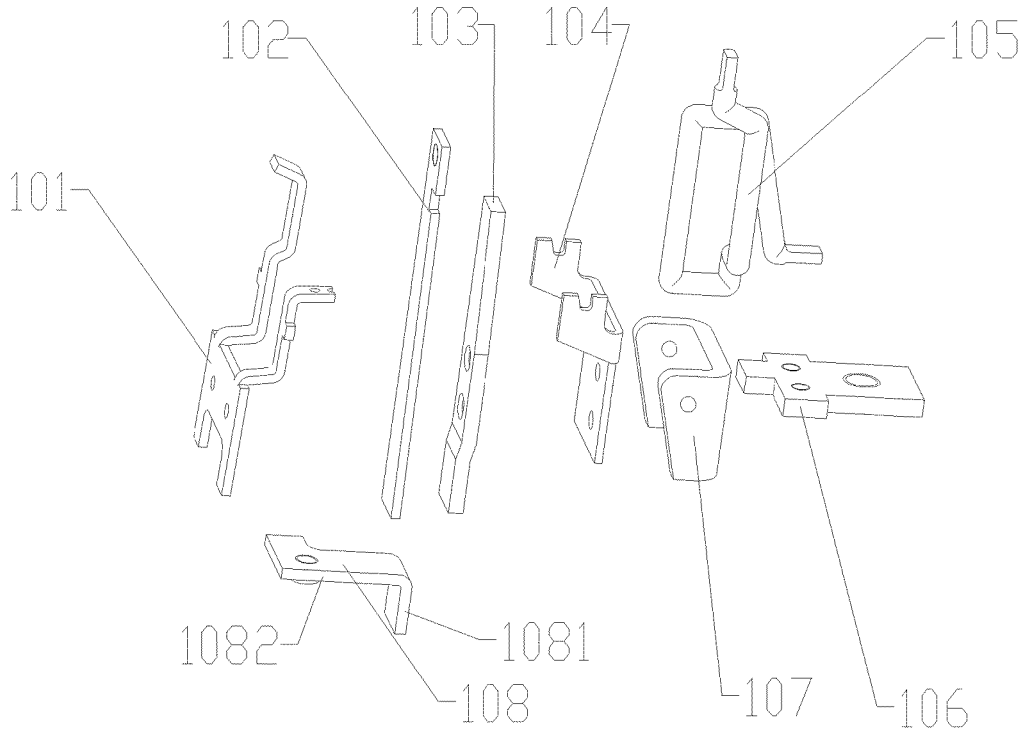
FIG. 2 is an exploded view of the clapping type electromagnetic system of the present invention-creation.

As shown in FIGS. 1 and 2, a clapping type electromagnetic tripping system of the present invention-creation comprises an iron core 107 with a U-shaped structure, a bracket 104, an armature 101, a heating element 103, a bimetallic element 102, a wire 105, a supporting member 108 and a connecting plate 106. The bracket 104 extends into a U-shaped groove of the iron core 107 and is fixedly connected with the iron core 107, a pair of grooves in which the armature 101 is mounted are formed in two sides of the upper end of the bracket 104, and the wire 105 connecting the heating element 103 and the connecting plate 106 surrounds the iron core 107 and the bracket 104. The bracket 104 twined round by or surrounded by the wire 105 is fixedly connected with the middle part of the heating element 103, and the bottom end of the heating element 103 and the bottom end of the bimetallic element 102 are fixedly connected with the supporting member 108 together; a pair of projections 1015 which are matched with a pair of grooves in the bracket 104 are disposed on corresponding positions on two sides of the armature 101, and the armature 101 is hung on the bracket 104 through the pair of projections 1015; and the armature 101 and the iron core 107 are arranged oppositely to form a magnetic loop, and one end of the armature 101 is attracted towards the iron core 107 so as to swing during short-circuiting. Both the heating element 103 and the wire 105 in a circuit loop penetrates through the magnetic loop, a magnetic field force will be generated in the magnetic loop when a short-circuited current sequentially flows through the heating element 103 and the wire 105, and the armature is attracted reliably due to a proportional relation between the magnetic field force and a square of the current penetrating through the magnetic loop. The clapping type electromagnetic tripping system disclosed by the present invention-creation is simple and reasonable in structure, can enable the armature to be attracted reliably and is suitable for use in a low-current molded case circuit breaker with a clapping type electromagnetic structure, and in particular in a clapping type electromagnetic tripping system of a specification of 63 A or less.

Figure 3:
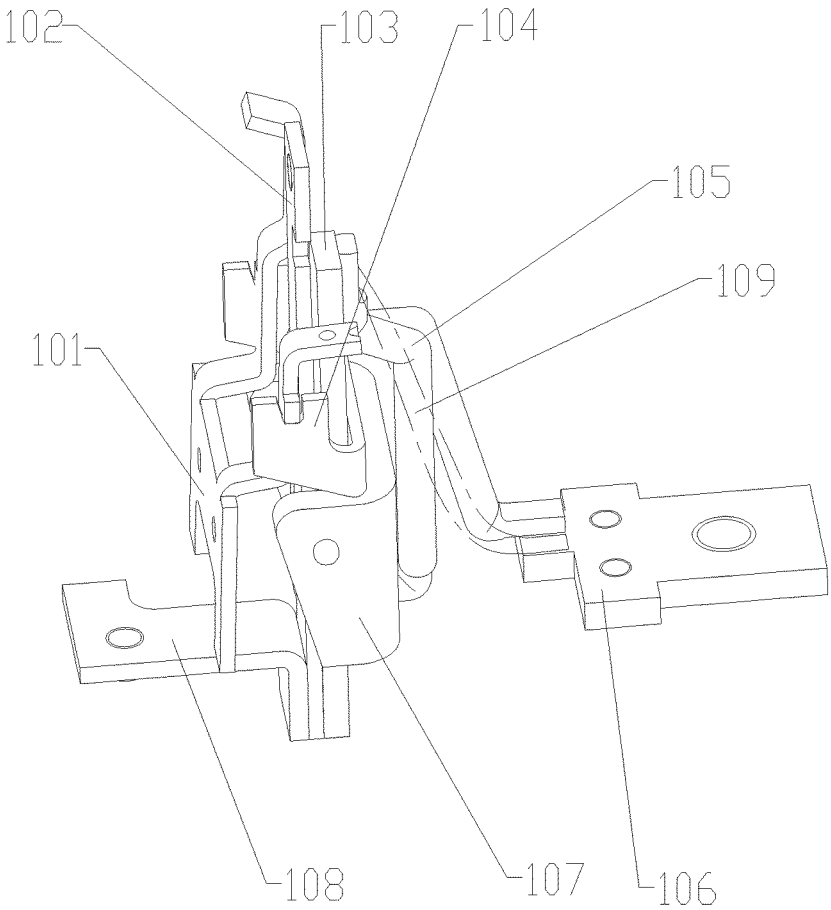
FIG. 3 is a structural view of another embodiment of the clapping type electromagnetic system of the present invention-creation.

FIG. 3 is a structural view of another embodiment of the clapping type electromagnetic system of the present invention-creation, and the embodiment as shown in FIG. 3 differs from the embodiment as shown in FIG. 1 in that: a second wire 109 which is connected with the wire 105 in parallel and does not twine round(surround) the bracket 104 and the heating element 103 is also connected between the heating element 103 and the connecting plate 106, and sectional areas of the wire 105 and the second wire 109 are reasonably allocated to ensure sufficient magnetic field force generated from current flowing through the wire 105.

Figure 4:
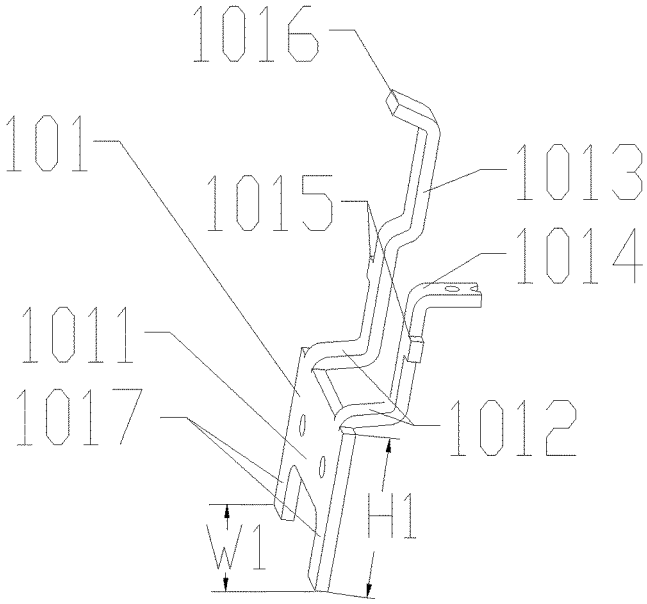
FIG. 4 is a structural view of an armature of the present invention-creation.

The structure of the armature of the present invention-creation is as shown in FIG. 4. The armature 101 comprises a sheet attracting portion 1011, a first hanging pillar 1013 and a second hanging pillar 1014 which are connected with the attracting portion 1011, and bending portions 1012 which are arranged at positions where the attracting portion 1011 is connected with the first hanging pillar 1013 and the second hanging pillar 1014, and extend towards the iron core 107, wherein the bending portions 1012 can increase a swing range of the armature effectively. A pair of projections 1015 which are in mounting fit to a pair of grooves of the bracket 104 are disposed on the first hanging pillar 1013 and second hanging pillar 1014, and a propping portion 1016 which is used for triggering a tripping action is disposed at the end portion of the first hanging pillar 1013 and is bent toward a direction away from the iron core 107 such that the reliability of triggering the tripping action is improved. The middle part of the bottom end of the attracting portion 1011 is recessed, a pair of bottom legs 1017 are disposed at two sides of the attracting portion 1011, the supporting member 108 is disposed under a recess of the middle part of the bottom end of the attracting portion 1011 to facilitate reduction of a volume of the electromagnetic tripping system, and the recess in the middle part of the bottom end of the attracting portion 1011 facilitates reduction of the weight of the armature; and a pair of bottom legs 1017 at two sides of the bottom end of the attracting portion 1011 are also very important, and the pair of bottom legs 1017 and two sides 1071 of the iron core 107 are arranged oppositely such that a suction force generated by a magnetic loop can be sufficiently utilized. The structure of the supporting member 108 under the recess in the middle part of the bottom end of the attracting portion 1011 is as shown in FIG. 2, and the supporting member 108 comprises a supporting member connecting sheet 1082 disposed under the recess in the middle part of the bottom end of the armature 101, and a supporting member fixing portion 1081 which is fixedly connected with the bottom end of the bimetallic sheet, wherein the conjunction between the supporting member fixing portion 1081 and the supporting member connecting sheet 1082 is of a vertical structure.

Figure 5:
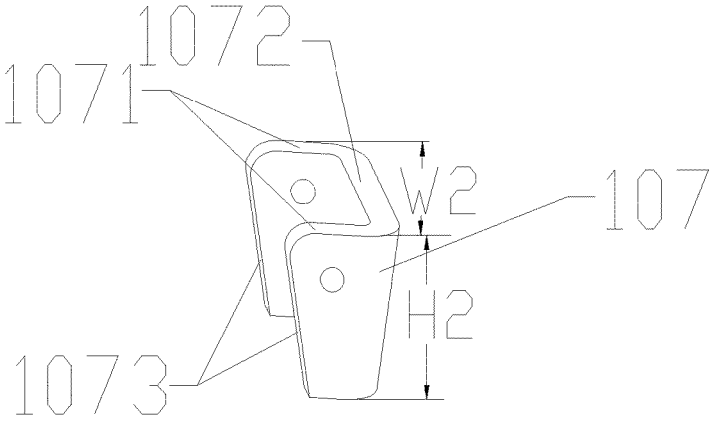
FIG. 5 is a structural view of an iron core of the present invention-creation.

The structure of the iron core of the present invention-creation is as shown in FIG. 5. The iron core 107 is of a U-shaped structure composed of two sides 1071 and a bottom surface 1072, wherein the two sides 1071 are uniform in shape and disposed symmetrically, and a bevel edge 1073 which can increase a swing range of the armature 101 along a movement direction of the armature 101 which is being attracted is disposed on each of the two sides. The iron core 107 and the attracting portion 1011 of the armature 101 are arranged oppositely such that the suction force generated by the magnetic loop can be utilized reasonably to ensure the reliability of triggering a tripping action. Two sides 1071 of the iron core 107 and a pair of bottom legs 1017 of the attracting portion 1011 are arranged oppositely, and a width W2 of the iron core 107 is equal to a width W1 of the attracting portion 1011. Further, a height H2 of the iron core 107 is equal to a height H1 of the attracting portion 1011, and the uniform heights are just a further preferred embodiment.

Figure 6:
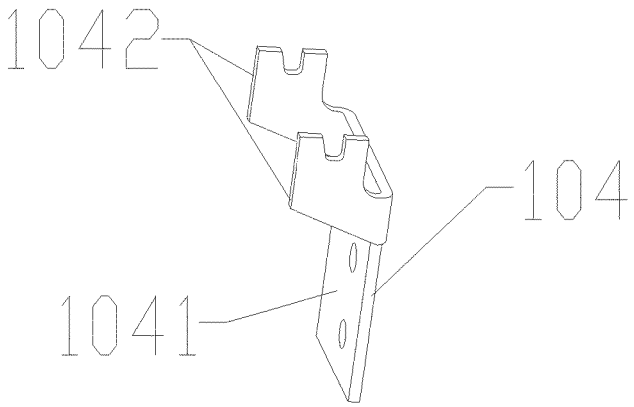
FIG. 6 is a structure view of a bracket of the present invention-creation.

A structure of the bracket of the present invention-creation is as shown in FIG. 6. The bracket 104 comprises a sheet assisting portion 1041 which extends into the U-shaped groove of the iron core 107 and is fixedly connected with a bottom surface 1072 of the iron core 107, and the assisting portion 1041 can increase the thickness of the iron core effectively; and a pair of armature supporting arms 1042 which extend toward the armature 101 are disposed at the upper end of the assisting portion 1041 which is fixedly connected with the bottom surface 1072 of the iron core 107 and can increase a swing range of the armature, and each of the armature supporting arms 1042 is provided with a groove which is mounting fit to the iron core 107.

According to the electromagnetic tripping system of the present invention-creation, a current flowing through a magnetic loop composed of the armature 101 and the iron core 107 increases sharply during short-circuiting to break a balance of the electromagnetic tripping system; the attracting portion 1011 of the armature 101 is attracted toward the iron core 107, and the armature 101 swings around a pair of grooves of the bracket 104; and a propping portion 1016 moves along a direction away from the iron core 107 to trigger tripping of the current breaker to realize protection to a load. In this embodiment, each of the iron core 107, the bracket 104 and the heating element 103 is provided with a connecting hole, and the connecting holes can be riveted once together. The bottom end of the heating element 103 and the bottom end of the bimetallic element 102 are fixedly connected with the supporting member 108 through welding. The wire 105 which twines round the iron core 107 and the bracket 104 is an enameled wire or a flexible connecting wire. Of course, the present invention-creation is not limited to above-mentioned technical solutions.

The above content is the further description made to the present invention-creation in combination with preferred embodiments, however, it will be not affirmed that the specific embodiments of the present invention-creation are only limited to these descriptions. Several simple deductions or replacements may also be made by those common skilled in the art to which the present invention-creation belongs, without departing from the conception of the present invention-creation. Such simple deductions and replacements should be understood to fall within the scope of the present invention-creation.

The invention claimed is:

1. A clapping type electromagnetic tripping system, comprising an iron core with a U-shaped structure, an armature, a heating element, a bimetallic element and a connecting plate, wherein a bracket extends into a U-shaped groove of the iron core and is fixedly connected with the iron core, and a wire connecting the heating element and the connecting plate surrounds the iron core and the bracket; the bracket twined round by the wire is fixedly connected with the middle part of the heating element, the bottom end of the heating element and the bottom end of the bimetallic element are fixedly connected with a supporting member together, and the armature is hung on the bracket twined round by the wire; and the armature and the iron core twined round by the wire are arranged oppositely to form a magnetic loop, and one end of the armature is attracted by the iron core so as to swing when short-circuit current is generated.

2. The clapping type electromagnetic tripping system according to claim 1, wherein, the armature comprises a sheet attracting portion, a first hanging pillar and a second hanging pillar which are connected with the attracting portion, and bending portions which are arranged at positions where the attracting portion is connected with the first hanging pillar and the second hanging pillar, and extend towards the iron core; and a pair of projections which are in mounting fit to the bracket are disposed on the first hanging pillar and second hanging pillar, and a propping portion which is used for triggering a tripping action and is bent in a direction away from the iron core is disposed at the end portion of the first hanging pillar.

3. The clapping type electromagnetic tripping system according to claim 1, wherein, the iron core is of a U-shaped structure composed of two sides and a bottom surface, the two sides are uniform in shape and symmetrically disposed, and a bevel edge which can increase a swing range of the armature along a movement direction of the armature which is being attracted is disposed on each of the two sides.

4. The clapping type electromagnetic tripping system according to claim 1, wherein, the bracket comprises a sheet assisting portion which extends into the U-shaped groove of the iron core and is fixedly connected with a bottom surface of the iron core, a pair of armature supporting arms which extends towards the armature is disposed at the upper end of the assisting portion which is fixedly connected with the bottom surface of the iron core, and each of the pair of armature supporting arms is provided with a groove which is mounting fit to the iron core.

5. The clapping type electromagnetic tripping system according to claim 2, wherein the middle part of the bottom end of the attracting portion of the armature is recessed, and a pair of bottom legs are disposed at two sides of the attracting portion.

6. The clapping type electromagnetic tripping system according to claim 2, wherein, the iron core is disposed opposite to the attracting portion of the armature, and a width W2 of the core iron is equal to a width W1 of the attracting portion of the armature.

7. The clapping type electromagnetic tripping system according to claim 6, wherein, a height H2 of the iron core is equal to a height H1 of the attracting portion of the armature.

8. The clapping type electromagnetic tripping system according to claim 5, wherein the supporting member comprises a supporting member connecting sheet which is disposed under a recess in the middle part of the bottom end of the armature, and a connecting member fixing portion which is fixedly connected with the bottom end of a bimetallic sheet, and the conjunction between the supporting member fixing portion and the supporting member connecting sheet is of a vertical structure.

9. The clapping type electromagnetic tripping system according to claim 1, wherein a second wire which does not twine round the bracket and the heating element and is connected to the wire in parallel is also connected between the heating element and the connecting plate.

10. The clapping type electromagnetic tripping system according to claim 1, wherein, the wire which twines round the iron core and the bracket is an enameled wire or a flexible connecting wire.

* * * * *